US008358249B2

(12) United States Patent
Toso et al.

(10) Patent No.: US 8,358,249 B2
(45) Date of Patent: Jan. 22, 2013

(54) MULTIBEAM ACTIVE DISCRETE LENS ANTENNA

(75) Inventors: Giovanni Toso, Haarlem (NL); Piero Angeletti, Lisse (NL); Gianfranco Ruggerini, Rome (IT); Giancarlo Bellaveglia, Rome (IT)

(73) Assignee: Agence Spatiale Europeenne, Paris Cedex (FR)

( * ) Notice: Subject to any disclaimer, the term of this patent is extended or adjusted under 35 U.S.C. 154(b) by 530 days.

(21) Appl. No.: 12/641,682

(22) Filed: Dec. 18, 2009

(65) Prior Publication Data

US 2010/0207833 A1 Aug. 19, 2010

(30) Foreign Application Priority Data

Dec. 18, 2008 (IT) ..... RM2008A0674

(51) Int. Cl.
*H01Q 19/06* (2006.01)

(52) U.S. Cl. ..... 343/754; 343/753; 343/840

(58) Field of Classification Search ..... 343/753, 343/754, 840
See application file for complete search history.

(56) References Cited

U.S. PATENT DOCUMENTS

| | | | | |
|---|---|---|---|---|
| 3,984,840 | A | 10/1976 | Dell-Imagine | |
| 6,147,656 | A * | 11/2000 | Luh | 343/753 |
| 6,421,021 | B1 * | 7/2002 | Rupp et al. | 343/753 |

FOREIGN PATENT DOCUMENTS

| | | | |
|---|---|---|---|
| EP | 1 041 673 | A2 | 10/2000 |
| EP | 1 191 630 | A1 | 3/2002 |
| EP | 1 291 962 | A1 | 3/2003 |
| EP | 2 090 995 | A1 | 8/2009 |
| WO | WO 94/11920 | A1 | 5/1994 |

OTHER PUBLICATIONS

Rao, S. K., *Parametric Design and Analysis of Multiple-Beam Reflector Antennas for Satellite Communications*, IEEE Antennas and Propagation Magazine, vol. 45, No. 4, Aug. 2003, pp. 26-34.
McGrath, D. T., *Planar Three-Dimensional Constrained Lenses*, IEEE Transactions on Antennas and Propagation, vol. AP-34, No. 1, Jan. 1986, pp. 46-50.
Hollung, S. et al., *A Bi-Directional Active Lens Antenna Array*, Antennas and Propagation Society International Symposium, 1997 IEEE, 1997 Digest vol. 1, Jul. 1997, pp. 26-29.

(Continued)

*Primary Examiner* — Tan Ho
(74) *Attorney, Agent, or Firm* — Alston & Bird LLP

(57) ABSTRACT

A multibeam antenna comprising: a plurality of primary radiating elements, each associated to a respective beam; and an active radiating structure comprising a first planar array of radiating elements, a second planar array composed by a same number of radiating elements, a set of connections between each radiating element of the first planar array and one corresponding element of the second planar array, and a set of power amplifiers for amplifying signals transmitted through said connections; wherein: the relative positions of the radiating elements of the first and second planar arrays and phase delays introduced by said connections are such that the radiating structure forms an active discrete converging lens; and said primary radiating elements are clustered on a focal surface of said lens, facing the first planar array; characterized in that said first and second planar arrays are both aperiodic. A method of manufacturing such an antenna.

18 Claims, 6 Drawing Sheets

OTHER PUBLICATIONS

Doyle, W., *On Approximating Linear Array Factors*, Memorandum RM-3530-PR, Feb. 1963, 26 pages.

Taylor, T. T., *Design of Circular Apertures for Narrow Beamwidth and Low Sidelobes*, IRE Transactions on Antennas and Propagation, vol. AP-8, 1960, pp. 17-22.

Bird, T. S. et al., *Optimization of Profiles of Rectangular Horns for High Efficiency*, IEEE Transactions on Antennas and Propagation, vol. 55, No. 9, Sep. 2007, pp. 2480-2488.

Search Report for Italian Application No. ITRM20080674 completed May 20, 2009.

* cited by examiner

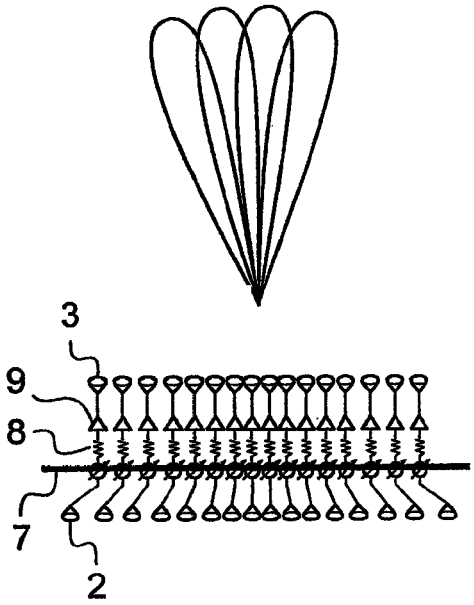
Fig.11A
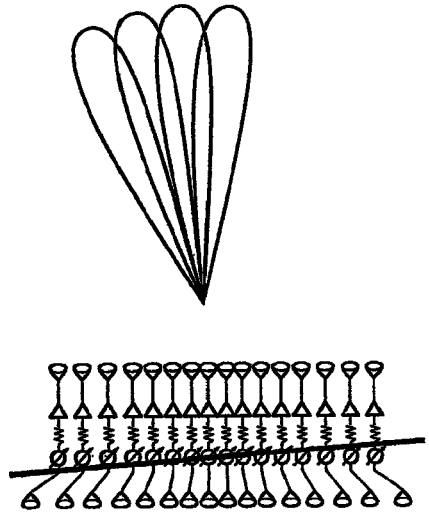
Fig.11B
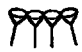
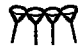
Fig.12
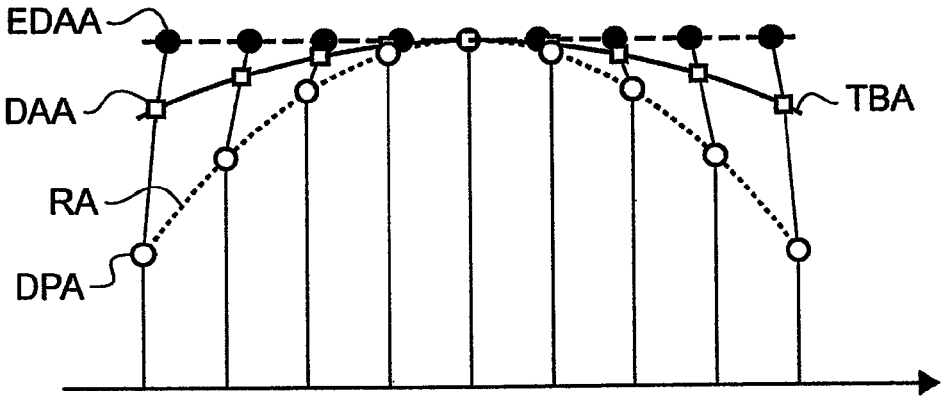

MULTIBEAM ACTIVE DISCRETE LENS ANTENNA

BACKGROUND OF THE INVENTION

The invention relates to a multibeam antenna, and in particular to a transmit and/or receive multibeam antenna for satellite applications, designed to operate in the microwave part of the spectrum (300 MHz-300 GHz).

It is well known in the art of antenna engineering that the generation of directive beams implies using antennas with large electric dimensions, usually based on reflectors.

A conventional solution for generating a coverage characterized by contiguous high directivity spot beams consists in using several reflector antennas—typically three or four in reflection and the same number in transmission—in order to generate interleaved beams. See S. K. Rao "Parametric Design and Analysis of Multiple-Beam Reflector Antennas for Satellite Communications", IEEE Antennas and Propagation Magazine, Vol. 45, No. 4, August 2003. This type of architecture presents severe problems of accommodation when used onboard satellites.

Phased arrays may allow generating a multibeam coverage using a single aperture. However they are very expensive, due to the high number of radiating feeds constituting the array and to the need for a complex beam-forming network.

Another possibility consists in adopting an antenna system based on microwave lenses. According to this approach, each beam is generated by a single feed, which is disposed on the focal surface of a lens; the field generated by each feed is converted by the lens into a directive beam. Conventional dielectric lenses are too heavy and lossy for large aperture antennas, and they require at least one curved surface, which make them difficult to manufacture. Moreover, large dielectric elements should be preferably avoided in satellites.

Discrete or "constrained" lens antennas constitute an interesting alternative to dielectric lenses.

A "discrete" or "constrained" or "bootlace" lens concept is illustrated in the paper by D. McGrath "Planar Three-Dimensional Constrained Lenses", IEEE Transactions on Antennas and Propagation, Vol. AP-34, No. 1, January 1986; see also document U.S. Pat. No. 3,984,840.

A discrete lens is basically constituted by a first array of radiating elements ("back array") and a second array ("front array") comprising the same number of radiating elements. Each element of the front array is connected to a single element of the back array via a respective waveguide or transmission line connection. This way a microwave signal received by an element of the back array propagates to the front array and is reemitted by the corresponding element of the front array (in the case of a transmitting antenna; the reciprocal is true for an emitting antenna). The connections have different lengths and therefore introduce different phase shifts. If the length of the connections going from the center towards the edges of the arrays is properly designed and if a particular relationship between the positions of corresponding radiating elements in the front and back array is satisfied, then the whole structure behaves like a converging lens.

Feeds (e.g. horn antennas) are disposed on the focal surface of the lens, facing the back array. The ensemble can constitute either a transmit or a receive, or a transmit/receive antenna.

A drawback of passive lens antennas of this kind is associated to the significant losses introduced: indeed, a large part of the power impinging on the back array (for a transmit antenna) or on the front array (for a receive antenna) is not intercepted by the radiating elements of said array. In reception, this reduces the achievable signal-to-noise ratio of the received signal, and in transmission this leads to an unacceptable waste of electrical power. Besides, exactly like for reflector antennas, a part of the power is not intercepted by the lens aperture: the corresponding losses are known as "spillover" losses.

These problems can be solved, or at least alleviated, by introducing active elements within the connections between the front and back radiating elements of the discrete lens (i.e. low-noise amplifiers for a receive lens, power amplifiers for a transmit lens). This way, the lens antenna becomes an Active Lens Antenna. This solutions is disclosed by the paper by S. Hollung and Z. B. Popovic "A bi-directional active lens antenna array", Antennas and Propagation Society International Symposium, 1997 IEEE, 1997 Digest Volume 1, 13-18 Jul. 1997 Page(s): 26-29, vol. 1.

While active lens antennas are simpler than phased array antennas because they do not require a beam forming network, they lack the flexibility of the latter. Moreover, they are still quite complex and heavy because a large number of radiating elements is required both in the front and in the back arrays.

SUMMARY OF THE INVENTION

The invention aims at providing an improved architecture for a discrete active lens multibeam antenna with better radiative performances and/or reduced volume, mass, cost and complexity.

According to the invention, this result is achieved by the multibeam antenna of claim 1, comprising a plurality of primary radiating feed elements, each one associated to a respective beam; and an active radiating structure comprising a first planar array ("back array") of radiating elements, a second planar array ("front array") composed by a same number of radiating elements, a set of connections between each radiating element of the first planar array and one corresponding element of the second planar array, and a set of power amplifiers for amplifying signals transmitted through said connections; wherein the relative positions of the radiating elements of the first and second planar arrays and phase delays introduced by said connections are such that the radiating structure forms an active discrete converging lens; and said primary radiating feed elements are clustered on a focal surface of said lens, facing the first planar array; characterized in that both said first and second planar array are aperiodic.

On the contrary, in a constrained lens antenna (either active or passive) according to the prior art, the front array elements are equispaced.

The inventors have started from the following consideration. In the case of a transmitting antenna, the electromagnetic field impinging on the edges of the lens is quite high (i.e. about −3 to −6 dB with respect to the maximum value) when low-directivity feeds are used in the focal area.

Such an amplitude aperture distribution is far from being optimal, and would lead to unsatisfactory radiation patterns with high sidelobe levels.

In principle, this could be avoided by using directive primary feeds, illuminating the back array with an edge taper of the order of −10/−12 dB. However, this is not compatible with a coverage constituted by multiple contiguous spot beams: indeed, this kind of coverage can only be implemented by providing primary feed elements with a small angular separation. But this is not possible with directive feeds, which are necessarily quite large. So it is necessary to use small primary feeds generating high spillover losses.

Active lens antenna allows overcoming the problem associated with spillover losses, because most of the RF power is generated within the lens. Moreover, an increased edge taper can be obtained by operating the amplifiers inside the active lens at different power levels. This, however, makes the structure of the lens more complex and/or hinders efficient operation of the amplifiers.

One idea at the basis of the present invention is to use the spacing of the radiating elements on the front array as an additional degree of freedom to realize a "virtual tapering", playing not (or not only) on the field amplitude but (also) on the density of the sampling of said field performed by the radiating elements ("density tapering"). The "density tapering" principle is described in the Memorandum RM-3530-PR by W. Doyle "On Approximating Linear Array Factors", February 1963, prepared for United States Air Force Project "Rand". See also European Patent Application n° 08290154 filed on Feb. 18, 2009, published on Aug. 19, 2009 with publication number: EP 2 090 995.

Moreover, a suitable aperiodic spatial distribution of the radiating elements of the front array allows reducing the grating lobes in the radiation pattern, even when the spacing between said elements is comparatively high in terms of wavelengths. This allows a reduction of the number of radiating element, and therefore of the cost and weight of the antenna, without leading to an unacceptable degradation of its radiative properties. The extent of this reduction depends on the field of view of the antenna. For example, let us consider an antenna embarked on a geostationary satellite for implementing a European multibeam coverage with 1° beams. The required field of view of such an antenna is between +/−3° and +/−4°. Use of an aperiodic front array allows a reduction of 25%-50% in the number of radiating elements with respect to a periodic, fully populated discrete lens.

Different embodiments of the multibeam antenna of the invention constitute the subject-matter of depending claims 2-15.

In a particularly advantageous embodiment of the invention, according to claims 12-15, a further reduction in the mass and weight of the antenna can be obtained by using, in the front array, extremely compact and efficient radiating horns.

Another object of the invention is a method of manufacturing such a multibeam antenna according to claims 16 and 17, said method comprising: a design step; and a physical manufacturing step; characterized in that said design step comprising the following operations:

(a) determining, on the front aperture of the lens to be manufactured, a reference intensity distribution, associated to a target radiation pattern (b) projecting the radiation pattern of one primary radiating element onto the surface of a first planar array of said lens, thus determining a first continuous planar intensity distribution;

(c) transforming said intensity distribution to the surface of a second planar array of the same lens, thus determining a second continuous planar intensity distribution;

(d) determining an aperiodic array layout of said second planar array, which samples said second continuous planar intensity distribution with a variable sampling density adapted for approximating said target radiation pattern; and (e) determining a corresponding array layout of said first array.

More precisely, said step (c) of transforming said projected pattern to the surface of the second planar array can comprise applying to said projected pattern: a geometrical transformation linking the radial positions of the radiating elements of said first and second planar arrays; and amplitude and phase transformations associated to said power amplifiers, phase shifters and attenuators.

BRIEF DESCRIPTION OF THE DRAWINGS

Additional features and advantages of the present invention will become apparent from the subsequent description, taken in conjunction with the accompanying drawings, wherein:

FIGS. 11A and 11B illustrate a method of performing beam steering with an active discrete aperiodic lens according to the invention; and FIG. 12 illustrates the use of "density tapering" to approximate the target radiation pattern of a reference aperture according to the design step of the manufacturing method of the invention.

DETAILED DESCRIPTION

Figure 1:
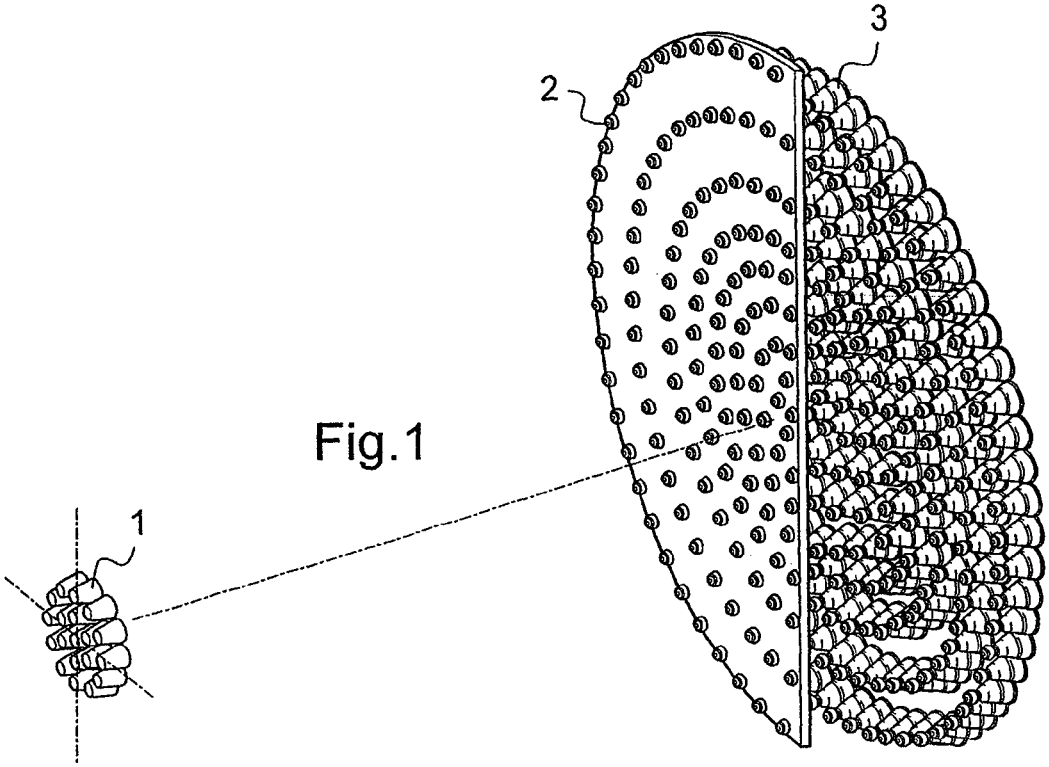
FIG. 1 shows the constitutive elements of the active discrete aperiodic lens.
Figure 2:
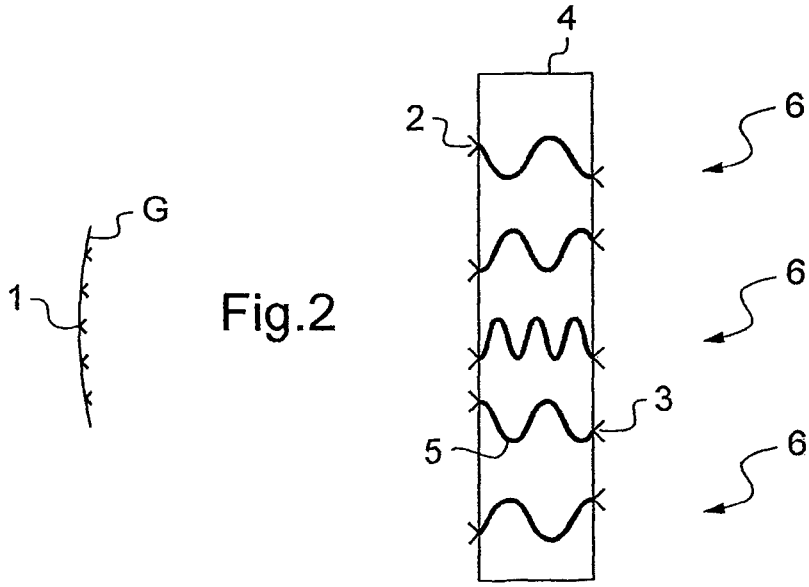
FIG. 2 illustrates the synoptic of a generic passive discrete lens.

For a better understanding of the present invention and the advantageous results obtained with respect to prior art, an exemplary block diagram of a generic passive discrete lens, working in reception, is shown on FIG. 1. While the radiating elements 3 of the front array form the radiative side of the lens, the elements 2 of the back array interact with the primary feeds 1 located in the focal zone of the lens. Each radiating element of the front array is interconnected to an homologue element of the back array through transmission lines 5 of different lengths such that an impinging plane wave 6 is focused in a point of the focal surface G of the lens where a primary feed capable of collecting the impinging plane wave energy is located.

Let ρ be the radial coordinate of a radiating element of the back array (ρ=0 at the center of the array), r the radial coordinate of the corresponding element of the front array and F the focal length of the lens. Then, as shown in the above-referenced paper by D. T. McGrath, the equation above has to be satisfied:

$$\rho = r\frac{F}{\sqrt{F^2 - r^2}} \quad [1]$$

The length W of the transmission line connecting the radiating elements identified by radial coordinates p and r is given by:

$$W = F + W_0 - \tfrac{1}{2}\sqrt{F^2 + \rho^2} \quad [2]$$

$W_0$ being an arbitrary constant.

A constrained lens satisfying equations 1 and 2 has two superimposed focal points, located on its optical axis at a distance F from the back array surface, on which a plane wave impinging perpendicularly on the front array would be focused. A plane wave impinging on the front array with an angle $\theta \neq 0$ would be approximately focused on a "focal point" lying on the focal surface $G(\theta)$ given by:

$$G(\theta) = F\left[1 + \frac{1}{2}\frac{\sin^2\alpha \cdot \sin^2\theta}{(1 - \sec\alpha)\cdot(1 + \sin\alpha \cdot \sin\theta)}\right] \quad [3]$$

$$\text{where } \alpha = \sin^{-1}\left(\frac{\max(r)}{F}\right).$$

Figure 3:
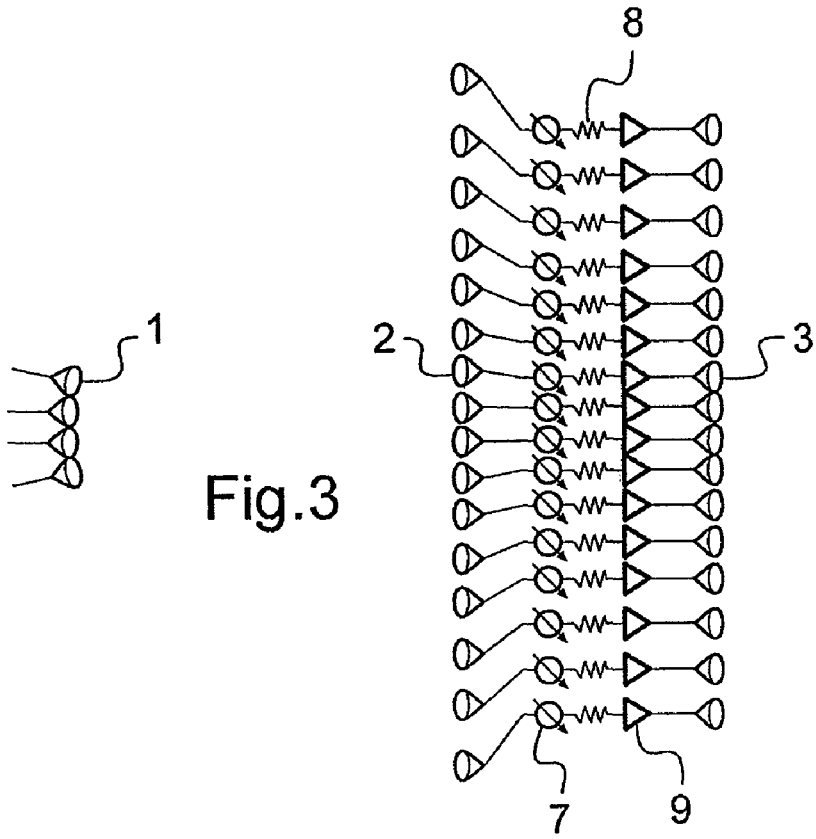
FIG. 3 shows a synoptic of a transmit active discrete aperiodic lens according to one embodiment of the invention.
Figure 5:
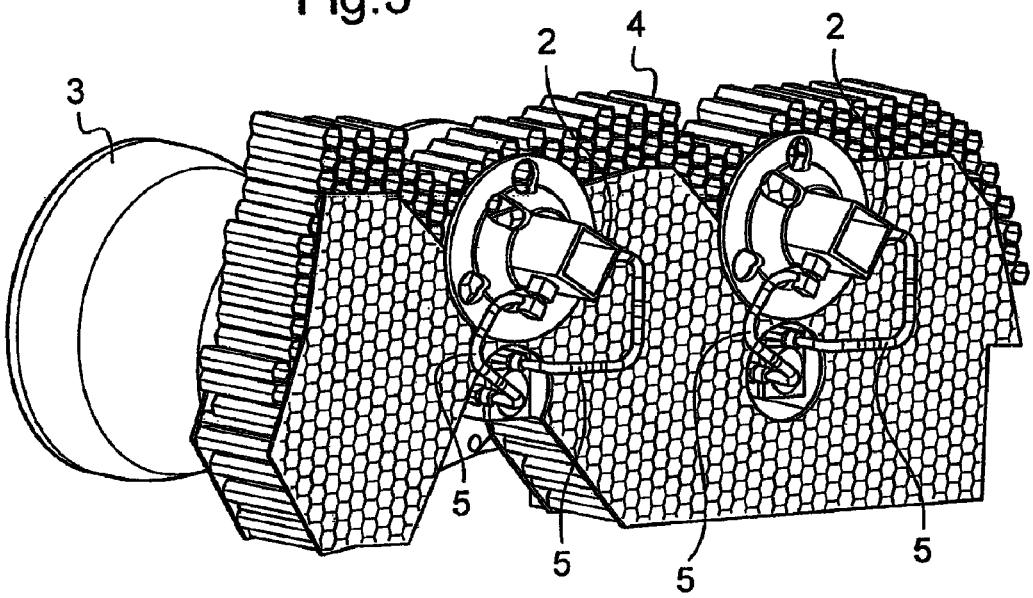
FIG. 5 shows a view of part of the back array of the active discrete aperiodic lens of FIG. 1.
Figure 6:
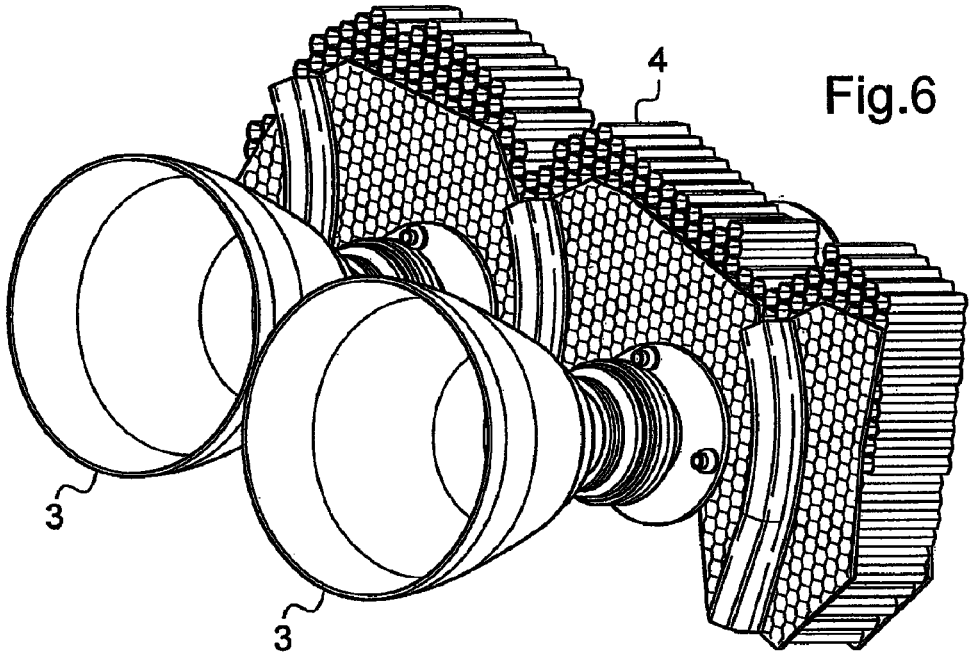
FIG. 6 shows a view of part of the front array of the active discrete aperiodic lens of FIG. 1.

As illustrated on FIG. 3, an active aperiodic discrete lens according to the present invention is essentially composed of:

- an array of primary feeds 1, such as simple horn antennas, with a number of feeds M equal to the number of beams of the coverage;
- a first aperiodic planar array, called "back-array", composed of small radiating elements;
- a second aperiodic planar array, called "front-array", composed of radiating elements 3, with different spacing with respect to the back-array;
- a sandwich structure 4 (see FIGS. 4 and 5), preferably of high thermal conductivity, capable of combining the functionality of structural support with that of thermal control, which can be eventually improved by means of a passive or active thermal control hardware 10 (see FIG. 6 for a more detailed view); this is of particular importance for transmit antennas;
- the interconnections 5 between the radiating elements of the front and back arrays for the transmission of each of the two orthogonal polarizations, (see FIG. 5 for a closer view), comprising various components: amplifiers 9 (see FIG. 3), variable control elements such as attenuators 8 and phase shifters and/or true delay lines 7 (for example to allow the electronic pointing of the antenna system as illustrated on FIGS. 11A and 11B, the compensation components' aging effects, etc.), transmission lines, etc. In a preferred embodiment of the invention, two separate transmission lines are provided for each pair of radiating elements, i.e. a transmission line per polarization. In a simplified embodiment, a single connection is provided for both polarizations, or the antenna is operated at a single polarization.

For a transmit antenna, each of the M beams of the overall coverage is generated exciting a single primary feed 1, that in turn excites all the N radiating elements of the back-array. The interconnections 5, including active and control elements, elaborate and transmit those excitations to the N radiating elements of the aperiodic front array which contribute together to form the radiated antenna pattern.

It can be appreciated that an active lens antenna as that illustrated on FIG. 3 has the following advantages:

- Modularity/scalability: the antenna architecture is based on a common building block (i.e. the radiating elements and its associated T/R module).
- RF-power pooling and RF-power-to-beam flexibility: all the High Power Amplifiers (HPA) contribute to the formation of any single beam implying that the overall RF power can be dynamically shared among the beams offering an intrinsic Traffic Reconfigurability.
- Graceful degradation: as a by-product of the distribution of the HPAs to the radiating elements, a failure of a number of them will not cause the loss of the full antenna function but will gracefully degrade its performance.

The transmit antenna of FIG. 3 can be transformed into a receive antenna by:

- replacing high-power amplifiers (e.g. Traveling Wave Tube Amplifiers, or TWTA) by low-noise amplifiers; and
- inverting the output and the inputs of the connections (the inputs of the amplifiers have to be connected to front array elements; attenuators and phase shifters preferably have to be arranged before the amplifier input).

A first innovative aspect of the invention is the fact that both the front and the back array of the discrete lens are aperiodic; on FIG. 3, it can be easily seen that the spacing of the elements of the front array 3 varies with their radial position. On the contrary, in the discrete lens known in the prior art, the front array is periodic while the back array is necessarily aperiodic due to the nonlinearity of equation [1]. This aspect will be described in reference to four different embodiments of the invention, illustrated on FIGS. 7 to 10.

More precisely, according to particular embodiments of the invention, the spacing of the elements of the front array can either increase monotonically from the array center toward the edges, or increase from the center toward the periphery and then decrease again near the edges.

In a first embodiment (FIG. 7) the active elements connecting the receiving elements of the back array to the respective transmit elements of the front array are all identical. In this embodiment, the feed pattern incident onto the back array acts as an amplitude tapering which must be considered in jointly optimizing the positions both of the front and of the back array elements. The intrinsic amplitude tapering can be exploited to help meeting the pattern performances in terms of sidelobe levels. In this embodiment the amplifiers work at a different level of output RF (Radio-Frequency) power and thus with different efficiencies.

In a second embodiment (FIG. 8), all the amplifiers are identical and all work at the same level of output RF power, thus guaranteeing an optimal efficiency in terms of DC to RF power conversion. This configuration allows decoupling the front and back array design. The synthesis of the front array is done optimizing its radiative performances accordingly to a uniform amplitude excitation profile (see below). The positions of the front elements are so determined and projected on the back array accordingly to the selected lens's focal length. The signals received from the back array, which exhibits a variable level, are equalized at a constant level by means of attenuators before entering in the amplifiers (i.e. the attenuation value decreases with the distance from the lens axis and is null for elements lying on the peripheral circumference).

In a third (FIG. 9) embodiment of the invention, different amplifiers power ratings are selected to facilitate the satisfaction of strict sidelobe requirements. In particular, two (or eventually more) classes of amplifiers are selected and the synthesis of the front array is done accordingly to the principle that amplifiers of the same class work at the same power level. The optimization of the aperiodic front array is so done independently from the back array. The positions of the front array elements determine, together with the selected focal length, the positions of the back array elements. The signals received from the back array are equalized by mean of attenuators in such a way to have the same input signal level for the same class of power amplifiers.

A forth (FIG. 10) embodiment of the invention is similar to the third but the input signals to the amplifiers are not equalized and the different tapering at the front array is accounted in the optimization of the radiative performances. This forth embodiment is comparable with the first in terms of achievable radiation performances with the exception that the differentiation in amplifier classes allows for a better matching of the required power level with the amplifier power thus increasing the DC-to-RF conversion efficiency.

A major difference between the second and third embodiment stands on the fact that better side lobe level performances can be expected when using the configuration with different classes of amplifiers at the expenses of an increased manufacturing complexity (increased number of different parts).

As illustrated on FIGS. 11A and 11B, the variable phase shifters arranged in the connections between radiating elements of the front and back array allow beam steering by introducing a linearly-varying phase shift. Phase shifters and variable attenuators also allow compensating for aging, tolerance and deployment errors of the antenna assembly elements.

Another innovative aspect of the invention is a synthesis method of such active aperiodic lens that is based on the following fundamental points:

i) synthesis of a reference surface current distribution satisfying the desired beam performance (such as beamwidth and sidelobe levels) realized, for example, by mean of expansion in Zernike surface polynomials or according to well known array synthesis techniques (see in particular the paper by T. T. Taylor, "Design of circular apertures for narrow beamwidth and low sidelobe," IRE Trans. On Antennas and Propagation, Vol. AP-8, 1960, pp. 17-22);

ii) preliminary synthesis of the aperiodic front-array with performances equivalent to the reference surface current distribution and based on the lens geometry and on the functionalities of the active and control elements;

iii) iterative refinement of the radiating elements positions to obtain the desired radiation performances.

Both the preliminary synthesis of the aperiodic front-array and its iterative refinement are performed taking into account the entire propagation of the signals from the primary feed 1 to the input of the various radiating elements of the front-array 3. In the design of a transmit antenna, for example, it is necessary to consider the real radiating elements' excitations due to: the radiation pattern of the primary feed 1, the radiation patterns of the radiating elements of the back-array 2, the relative geometry and the different path lengths between primary feed and back-array radiating elements. Furthermore it is necessary to account for the signal processing through the amplifiers and the other control elements between the output of the radiating elements of the back-array 2 and the input of the radiating elements of the front-array 3.

More precisely, step i.) comprises the following operations:

A. Fixing the main technical requirements for the antenna: operating frequency and bandwidth, polarization, gain, sidelobe level isolation, field of view, beams characteristics, etc. . . .

B. Determining the dimension of the front aperture, and a possible amplitude aperture tapering (i.e. a reference surface current distribution) allowing satisfying the requirements of point A. This tapering may be quite arbitrary, but in most of the cases a real positive amplitude tapering with circular symmetry is considered.

Before performing step ii.), two conventional design operations are required:

C. Selecting the focal distance F as a function of the front aperture diameter D. As an example an antenna with F/D=2 may be considered.

D. Choosing the primary feeds and their locations on the focal surface of the active constrained lens. In particular, a Single Feed Single Beam (SFSB) antenna can be considered, wherein every feed generates only one beam (number of beams, M, equal to the number of feeds);

E. Deriving the dimension of the back array, starting from the value of the focal distance and from the dimension of the front array, the back aperture of the lens is derived using the procedure introduced by McGrath (see the above-referenced paper of this author).

Step ii comprises:

F. Projecting the radiating pattern of the feeds onto the back aperture. This projection takes into account the different path lengths of the fields reaching different part of the back aperture from the feeds. Besides, the field projection depends on the field polarization: the polarization component whose electric field is not oriented parallel to the back surface of the lens is projected via a "cosine" term depending on the position considered on the back aperture (the cosine term tends to the value 1 when looking at the center of the back aperture, and tends to be minimum at the edges of the back aperture). In practice, this operation can be simplified by only considering the radiation pattern of one primary feed, in particular the central one.

G. Transforming the field distribution from the back to the front aperture. Using again the McGrath equation, the distribution obtained in the previous point is transformed to the front aperture. This transformation simply implies a nonlinear contraction of the distribution because, for this kind of constrained discrete lenses, the back aperture is larger with respect to the front one.

Figure 7:
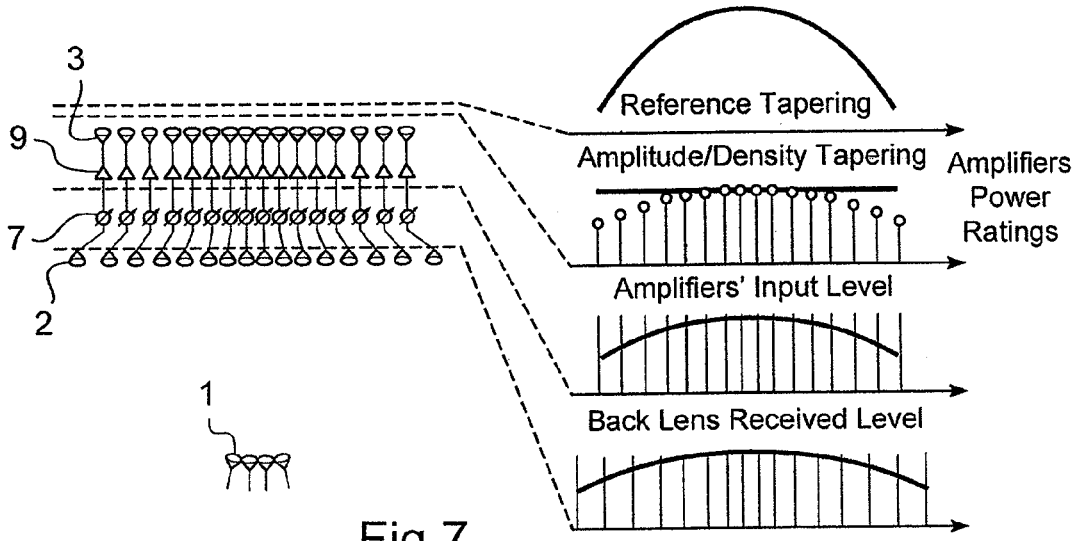
FIGS. 7-10 illustrate four different embodiments of an active discrete aperiodic lens according to the invention.

The transformation can also take into account amplitude and phase transformation introduced by said attenuators, phase shifters and amplifiers, and which constitute additional degrees of freedom for designing the active lens. e.g. in the embodiment of FIG. 7 the intensity distribution on the back surface of the lens is not only contracted according to McGrath's equation, but is also converted into a flat distribution by the variable attenuators.

Note that we are considering continuous apertures: the discrete structure of the lens has not yet being introduced in the design procedure.

At this point two real positive continuous distributions have been defined on the front aperture of the active lens: the reference continuous distribution derived at the point B, to be approximated in order to satisfy the antenna requirements; and the one derived at the point G, representing the pattern of a single feed converted from the back aperture into the front aperture of the lens.

H. Determining a suitable aperiodic sampling of the front aperture introducing a "density tapering" according to a weighting defined by the target pattern in such a way that the radiating pattern of the aperiodic array approximates the target radiation pattern.

This essential step of the lens design can be illustrated with the help of FIG. 12 wherein:

Dotted curve RA represents the field intensity distribution of the reference aperture. It is assumed that the aperture is circular, and that the field intensity distribution shows rotational symmetry; therefore curve RA represents, more exactly, a section of the distribution along a diameter of the aperture.

Continuous curve TBA represents the field intensity impinging on the back array, transformed into a corresponding front array intensity distribution according to McGrath's equation. In this exemplary case, the power amplifiers of the active lens introduce a constant amplification; therefore they do not modify the shape of the field intensity distribution on the front array: the present case corresponds to the embodiment of FIG. 7. It should be noted that curve TBA represents a (conceptual) continuous field distribution, as the discrete structure of the lens has not yet being introduced.

The black dots labeled as EDAA represent the positions of the radiating elements of a hypothetical equi-amplitude aperiodic array approximating the radiation pattern of the reference aperture RA. These position can be determined using known techniques, including numerical methods, the equal-area method disclosed by the above-referenced paper by W. Doyle (generalized to a bidimensional, geometry with rotational symmetry) and the graphical method disclosed by above-cited European Application EP 2 090 995. More precisely, it is assumed that the radiating elements are equi-spaced along rings whose radii are represented by the EDAA dots.

The white dots labeled as DPA sample periodically the RA curve. They correspond to the positions of the radiating elements of a hypothetical non equi-amplitude periodic array approximating the radiation pattern of the reference aperture RA. The amplitude associated to each radiating element is determined by the RA curve. Like for the case considered above, it is assumed that the radiating elements are equispaced along rings whose radiuses are represented by the DPA dots.

The white squares labeled as DAA correspond to the positions of the radiating elements of an aperiodic array sampling the continuous field distribution represented by the TBA curve in order to approximate the reference radiation pattern. Again, it is assumed that the radiating elements are equi-spaced along rings whose radiuses are represented by the DAA dots. These positions can be obtained graphically as the intersections between the TBA curve and the straight lines connecting each EDAA point with a corresponding DPA point.

The synthesis of the aperiodic front array of the discrete lens could stop here, leading to an array formed by radiating elements placed on concentric rings of varying radiuses.

It is also possible to use the array obtained this way as a starting point for an iterative refinement based on numerical methods. For example, the radius of a ring can be slightly changed at each iteration and the corresponding derivative of a suitable objective function can be evaluated. The objective function can be, e.g. a (weighted) quadratic mean error between the actual radiation pattern and the target one. After repeating this operation for all rings, a Quasi-Newton optimization procedure can be applied to find improved radiuses reducing the value of the objective function.

As a further refinement, the positions of the radiating elements can be optimized individually, thus leading to an array which is no longer constituted by elements disposed on concentric rings.

The design procedure is global in the sense that the characteristics of the elements of every subsystem (front array, back array, feed array, transmission lines, active elements) are derived and traded-off taking into account the coupling with the other subsystems of the entire antenna.

The design procedure described above refers more particularly to the embodiment of FIG. 7.

Figure 8:
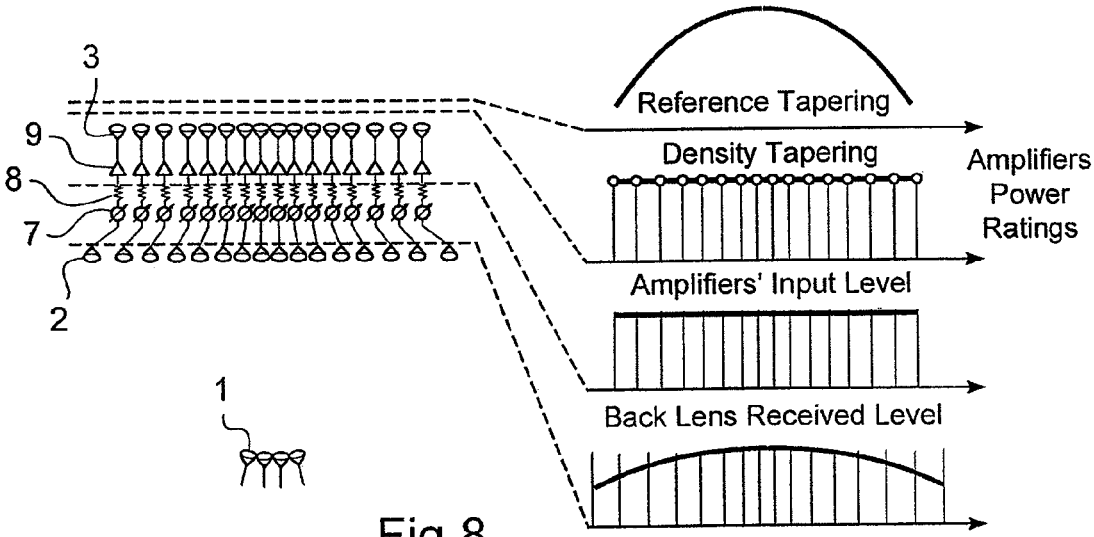

In the case of the embodiment of FIG. 8, where intensity equalization is performed using variable attenuators, the front array is directly defined by the EDAA dots (neglecting a possible iterative refinement).

Figure 9:
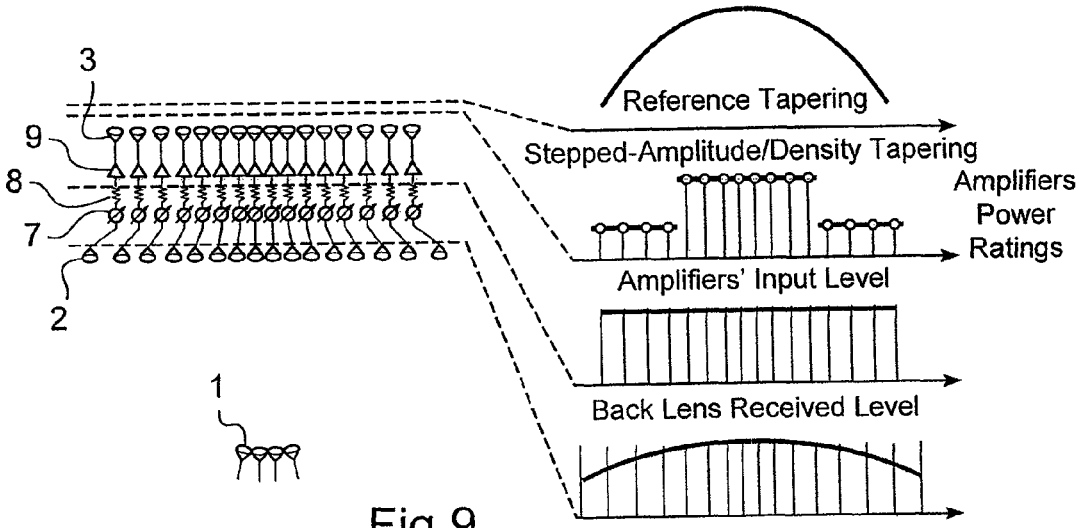
Figure 10:
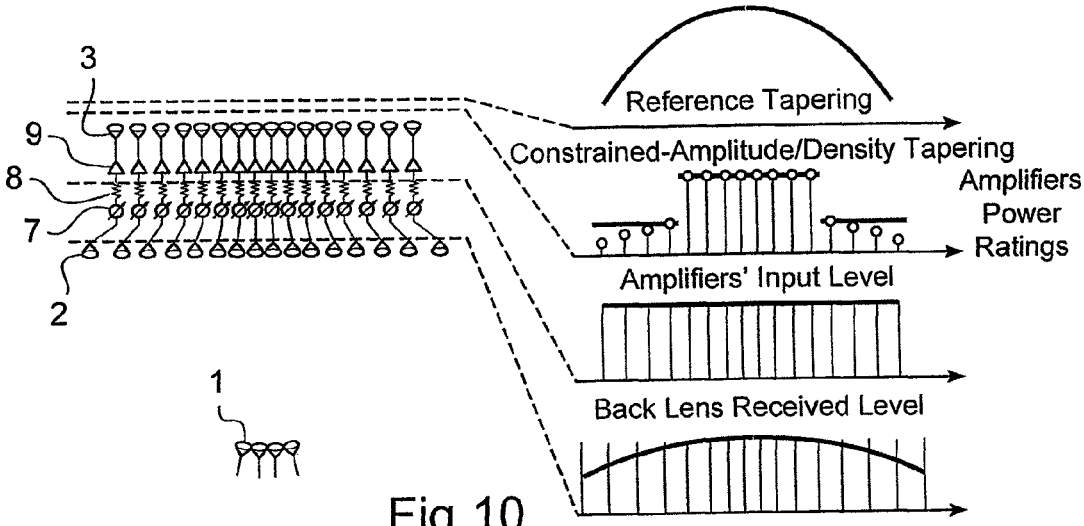

In the case of the embodiments of FIGS. 9 and 10, the EDAA dots should correspond to the position of the radiating elements of a stepped-amplitude (instead of an equi-amplitude) periodic array.

An additional aspect of the invention is the sandwich support structure, which can be realized with high thermal conductivity materials and combines structural support and thermal management functionalities, thus simplifying the active lens system and making it relatively simple, thin and easy to accommodate on-board the satellite.

More precisely, the sandwich structure can comprise a metal (e.g. aluminum) honeycomb core between two fiber-reinforced composite skins. In particular, the core can be made of aluminum and the skins of CFRP (Carbon Fiber Reinforced Plastic).

The metal core will help thermal balancing of front and rear skins of the sandwich. Even more importantly, the expansion of the core will match the expansion of the structure that supports the radiating elements, avoiding critical thermal stresses.

The skins can be made by several layers of ultra high modulus mono-directional fiber composites with different fiber orientations, the stacking sequence of the layers being chosen in order to provide a quasi isotropic behavior of the skin (typically +60°, 0, −60°, repeated for the number of times identified by analyses to achieve the required stiffness performances). The recently-available Thornel K-1100 fibers are particularly well-suited for this application.

The use of high thermal conductivity CFRP material leads to a sandwich with thermal properties which can be even better than those of aluminum and copper. This is important to spread the heat generated by the active element of the constrained lens, particularly in transmit antennas.

In the transmit antenna the thermal management can be empowered by passive and/or active thermal control devices. These devices can be e.g. heat pipes (reference 10 on FIG. 6) with a nearly radial configuration to bleed out the heat from the discrete lens center. Moving from the center to the periphery, additional radial heat pipes can be added to achieve a nearly uniform ratio of heat pipe active area versus cooled surface. Advantageously, heat pipes can be bent to route among the active elements.

At the edge of the discrete lens, the heat pipes can be connected to a heat radiation system that shall be designed according to the satellite configuration.

An alternative to the heat pipes is a closed loop fluid circulation system, but this would make the system more complex.

The external faces of the discrete lens that can be exposed to sun radiation shall be covered by a dedicated sunshield reducing sun input, allowing infrared emission and with acceptable impact on RF performances.

Still and additional aspect of the invention is the novel design of the antenna radiators constituting the front array.

Horn antennas are widely used as individual radiator feeds for reflectors and lens antennas. Profiled and stepped horns permit the designer having some extra degrees of freedom to play with in optimizing the horn performances. Usually stepped horns have a rectangular cross section.

One aspect of the invention is the use of new horns, which are circular and very compact, with a typical ratio between the horn length and the aperture diameter comprised between 1 and 2 and preferably between 1 and 1.5 (e.g. equal to 1.35) and a diameter of 3-10λ and preferably 3-7λ, λ being the wavelength of the radiation to be emitted or received, at the center of the operating band of the antenna.

Their small diameter allows arranging the radiating elements close to each other, which can be required to achieve an efficient "density tapering", and therefore a radiation pattern approaching the reference pattern. The small length reduces the size and weight of the active lens, which is essential for space applications.

A unique feature of the horns of the invention is that they are optimized both in terms of Efficiency (>90% in the 19.7÷20.2 GHz frequency band) and of longitudinal depth.

A horn according to the invention presents a smooth and very "wavy" profile without discontinuities to achieve high efficiency (>90%) and thereby optimum mode conversion. This profile is continuous but:

- is non-monotonic, i.e. the horn diameter does not increases monotonically along its axis; and
- comprises a high number of inflexion points, namely 10 or more and preferably 20 or more.

The design of this circular aperture radiating element is inspired by the one proposed, for the design of rectangular aperture horns, by T. S. Bird and C. Granet in their paper: "Optimization of Profiles of Rectangular Horns for High Efficiency", IEEE Transaction on Antennas and Propagation, Vol. 55, N. 9, September 2007.

The differences are:

- the aperture shape (circular instead of rectangular); and, most importantly:
- the efficiency, the return loss and the structure length are jointly optimized.

The design is based on a spline representation of the horn profile and the mode matching technique for circular waveguide. This spline representation is based on a series of points (or nodes), typically few tens, moved by the iteration algorithm. A cubic spline is then fitted to these nodes.

More precisely:

- The mode-matching technique (for rectangular or circular waveguide structures) is well known to the designer of passive microwave components for antenna feed systems. It consists in developing the field in the guiding structure in modes with unknown coefficients, in applying then the appropriate boundary conditions at the interfaces, and solving the associate linear system. A typical application of this technique is the analysis of the discontinuity formed by two waveguides of different sizes. The main advantage of this modal analysis is the rapidity of its calculations and for this reason is frequently used to design microwave structures with optimization algorithms based on iterative procedures performing a mode-matching analysis at each step.
- The horn input diameter and the horn aperture diameter are assigned, according to a given frequency band and other antenna aspects. A series of several (10 or more, and preferably 20 or more, in the case of the invention) control points (or nodes) of the horn profile are placed between the horn input and the horn aperture and equally spaced along the horn axis. At each iteration of the optimization algorithm, the distance of one of these control points from the horn axis is changed and the horn profile in the closeness of this point is modified according to a spline representation that is a special function defined piecewise by polynomials.
- A unique feature of the design procedure of the inventive horns is represented by the combined optimization, which takes into account both gain and size. The Optimization is based on Quasi-Newton method applied in order to minimize an Objective Function. In a particular embodiment, the objective function is defined as follows.

$$f_1 = 1 - \frac{\text{gain}}{directivity_{max}}$$

$$f_2 = \frac{depth_{horn} - depth_{optimum_horn}}{depth_{optimum_horn}}$$

$$\text{Obejective Function} = f_1^2 + f_2^2$$

where $directivity_{max}$ is the maximum directivity which can be obtained for a given aperture diameter and $depth_{optimum_horn}$ is a "target" depth of the horn (lower than that of the most compact that one can actually expect being able to design).

The term $f_1$ permits optimizing the Aperture Efficiency of the horn, minimizing at the same time the return loss of the antenna (because the gain instead of the directivity is appearing in the numerator). The term $f_2$ permits minimizing the difference between the depth of the horn and the target minimum depth one is looking for. The designer starts with a standard conical horn, with a profile linearly growing. As explained above, several equispaced control points are selected (in the order of 10-20 points, sometimes more) along the horn axis. At each iteration, the radial position of every point along the profile is locally perturbed, slightly increasing or decreasing the local radius. Then, the derivative of the Objective Function is evaluated and stored. After that, the control point is placed in the previous position. The procedure is repeated for all the control points. Note that only the term $f_1$ is changing because all the control nodes are modified only in the transversal plane (i.e. the depth of the horn is not changed). At the end a number of partial derivatives equal to the number of control points are evaluated. At this point, the depth of the horn is locally perturbed and the corresponding variation in the Objective Function is recorded (now the term $f_2$ is changing). The designer has now evaluated N+1 local derivatives (N with respect to the local radii associated to the control points, 1 associated to the depth of the entire horn). By applying a well known Quasi-Newton optimization procedure (or a similar one) the new positions of the control points and the new depth of the horn are derived in order to minimize the Objective Function. The entire procedure is iterated until stable and satisfactory results are obtained. Because the horn antenna has to respect assigned performances in an entire frequency bandwidth, the procedure is iterated also with respect to the frequency. If, for instance, the final Aperture Efficiency does not exceed a value of 90% in the full bandwidth, the desired (or optimum) depth of the horn is increased.

Figure 4:
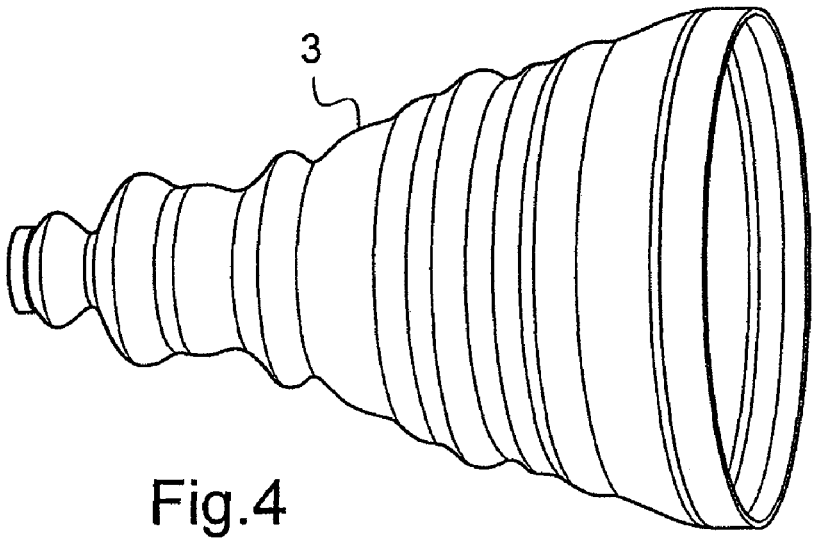
FIG. 4 shows a three-dimensional horn used in the front array.

As evident looking at FIG. 4, the obtained profile is locally smooth but strongly oscillating. All the oscillations permit to maintain satisfied the performances with a really compact horn.

Following this method the algorithm carries out a complex profile shaping. FIG. 4 shows the 3D model of a compact horn designed for the frequency band 19.7÷20.2 GHz. The aperture diameter is 104 mm (7λ, λ being, again, the wavelength at the central frequency of the operating band of the antenna), the horn length is 141 mm while the main electrical characteristics are reported in Table 1.

Due to the high efficiency the compact horn presents quite small cross-polarization levels typically not greater than −30 dB.

TABLE 1

| Characteristics of the compact circular horn | | | | |
|---|---|---|---|---|
| F [GHz] | D [dBi] | Eff. [%] | RL [dB] | Cross [dBi] |
| 19.7 | 26.22 | 90.9 | −18.04 | −3.6 |
| 19.95 | 26.52 | 95.0 | −23.07 | −5.0 |
| 20.2 | 26.50 | 92.3 | −20.92 | −4.12 |

On Table 1, "D" represents the directivity, expressing the maximum directivity achieved with respect to the limit value associated to a uniform aperture, "RL" the return losses, "Eff" the aperture efficiency, "Cross" the absolute level of the cross-polarized signal.

It should be understood that the antenna architecture of the invention, although particularly suited for space applications and for operation in the microwaves part of the spectrum, can also be used in non-spatial (e.g. terrestrial) applications and in other regions of the electromagnetic spectrum.

The invention claimed is:

1. A multibeam antenna comprising:

a plurality of primary radiating elements, each one associated to a respective beam; and an active radiating structure comprising a first planar array of radiating elements, a second planar array composed by a same number of radiating elements, a set of connections between each radiating element of the first planar array and one corresponding element of the second planar array, and a set of power amplifiers for amplifying signals transmitted through said connections; wherein:

the relative positions of the radiating elements of the first and second planar arrays and phase delays introduced by said connections are such that the radiating structure forms an active discrete converging lens; and said primary radiating elements are clustered on a focal surface of said lens, facing the first planar array;

characterized in that both said first and second planar arrays are aperiodic.

2. A multibeam antenna according to claim 1, wherein each connection of the active radiating structure is provided with a respective variable phase shifter and a fixed or variable attenuator.

3. A multibeam antenna according to claim 2, wherein:

said power amplifiers are identical with a same gain; and said fixed or variable attenuators are configured to introduce a same attenuation, or no attenuation.

4. A multibeam antenna according to claim 2, wherein:

said power amplifiers are identical with a same gain, and are operated at a same power level;

said fixed or variable attenuators are configured to equalize the signals at the inputs of said amplifiers.

5. A multibeam antenna according to claim 2, wherein:

said power amplifiers are divided in classes, the amplifiers of each class being operated at a same power level and being associated to radiating elements of said second array belonging to a same annulus; and said fixed or variable attenuators are configured to introduce a same attenuation, or no attenuation.

6. A multibeam antenna according to claim 2, wherein:

said power amplifiers are divided in classes, the amplifiers of each class being operated at a same power level and being associated to radiating elements of said second array belonging to a same annulus; and said fixed or variable attenuators are configured to equalize the signals at the inputs of said amplifiers.

7. A multibeam antenna according to claim 2, further comprising means for driving said variable phase shifters in order to steer the beams.

8. A multibeam antenna according to claim 1, wherein the spacing between contiguous radiating elements:

either increases monotonically with their radial distance from an array center; or increases with their radial distance from an array center, then decreases near an edge of the array.

9. A multibeam antenna according to claim 1, wherein said power amplifiers are operated at different power levels, showing either a continuous or a stepped variation.

10. A multibeam antenna according to claim 1, wherein said first and second planar array are formed on opposed faces of a sandwich structure, said connections and power amplifiers being located within said sandwich structure, and wherein said sandwich structure comprises a metallic honeycomb core between two skins composed by a plurality of layers of carbon-fiber reinforced composite with different orientations.

11. A multibeam antenna according to claim 10, wherein said sandwich structure is provided with a cooling system.

12. A multibeam antenna according to claim 1, wherein the radiating elements of said second planar array are profiled circular horns with a ratio between the length and the aperture diameter comprised between 1 and 2, and a non-monotonic profile with at least 10 inflexion points.

13. A multibeam antenna according to claim 12, wherein the profile of said radiating elements of said second planar array is defined by a spline function.

14. A multibeam antenna according to claim 12, wherein said radiating elements of said second planar array have an aperture diameter comprised between 3 and 10 times, and preferably between 3 and 7 times, the nominal operational wavelength of the antenna.

15. A multibeam antenna according to claim 12, wherein the profile of said radiating elements of said second planar array is designed in order to ensure a radiating efficiency greater or equal to 90% within a nominal operational frequency band of the antenna.

16. A multibeam antenna according to claim 1, wherein the radiating elements of said second planar array are profiled circular horns with a ratio between the length and the aperture diameter comprised between 1 and 1.5, and a non-monotonic profile with at least 20 inflexion points.

17. A method of manufacturing a multibeam antenna according to any of the preceding claims comprising:

a design step; and a physical manufacturing step;

characterized in that said design step comprising the following operations:

(a) determining, on the front aperture of the lens of the antenna to be manufactured, a reference intensity distribution (RA), associated to a target radiation pattern (b) projecting the radiation pattern of one primary radiating element onto the surface of a first planar array of said lens, thus determining a first continuous planar intensity distribution;

(c) transforming said intensity distribution to the surface of a second planar array of the same lens, thus determining a second continuous planar intensity distribution (TBA);

(d) determining an aperiodic array layout (DAA) of said second planar array, which samples said second continuous planar intensity distribution with a variable sampling density adapted for approximating said target radiation pattern; and (e) determining a corresponding array layout of said first array.

18. A method according to claim 17, wherein said step (c) of transforming said projected pattern to the surface of the second planar array comprises applying to said projected pattern:

a geometrical transformation linking the radial positions of the radiating elements of said first and second planar arrays; and amplitude and phase transformations associated to said power amplifiers, phase shifters and attenuators.

* * * * *

UNITED STATES PATENT AND TRADEMARK OFFICE

CERTIFICATE OF CORRECTION

PATENT NO. : 8,358,249 B2
APPLICATION NO. : 12/641682
DATED : January 22, 2013
INVENTOR(S) : Toso et al.

It is certified that error appears in the above-identified patent and that said Letters Patent is hereby corrected as shown below:

In the Specifications

Column 4,
Line 61, "coordinates p" should read -- coordinates ρ --.

Signed and Sealed this
Twenty-third Day of April, 2013

Teresa Stanek Rea
*Acting Director of the United States Patent and Trademark Office*